US005590444A

United States Patent [19]

Krauss

[11] Patent Number: 5,590,444

[45] Date of Patent: Jan. 7, 1997

[54] SIDE RELEASE BUCKLE WITH IMPROVED DISTRIBUTION OF STRESS UNDER LOADS

[75] Inventor: Mark J. Krauss, East Greenwich, R.I.

[73] Assignee: American Cord & Webbing Company, Inc., Woonsocket, R.I.

[21] Appl. No.: 284,182

[22] Filed: Aug. 2, 1994

[51] Int. Cl.[6] ..... A44B 11/26

[52] U.S. Cl. ..... 24/625

[58] Field of Search ..... 24/614–616, 625, 24/633

[56] References Cited

U.S. PATENT DOCUMENTS

| | | |
|---|---|---|
| D. 289,622 | 5/1987 | Crowle et al. . |
| D. 300,614 | 4/1989 | Geldwerth . |
| D. 301,566 | 6/1989 | Heiberger . |
| D. 303,233 | 9/1989 | Jang . |
| D. 308,186 | 5/1990 | Udelhofen et al. . |
| D. 312,430 | 11/1990 | Crowle . |
| D. 312,986 | 12/1990 | Bianchi . |
| D. 341,105 | 11/1993 | Lovato . |
| 1,324,629 | 12/1919 | Tabler . |
| 1,429,155 | 9/1922 | Metcalf . |
| 1,999,167 | 4/1935 | White . |
| 3,192,588 | 7/1965 | White . |
| 3,262,169 | 7/1966 | Jantzen . |
| 3,343,229 | 9/1967 | Tanaka . |
| 3,430,306 | 3/1969 | Tareau . |
| 4,035,877 | 7/1977 | Brownson et al. . |
| 4,052,774 | 10/1977 | Noda . |
| 4,150,464 | 4/1979 | Tracy . |
| 4,171,555 | 10/1979 | Bakker et al. . |
| 4,282,634 | 8/1981 | Krauss . |
| 4,569,106 | 2/1986 | Lovato . |
| 4,577,377 | 3/1986 | Kasai . |
| 4,608,735 | 9/1986 | Kasai . |
| 4,662,040 | 5/1987 | Terrell et al. . |
| 4,672,725 | 6/1987 | Kasai . |
| 4,779,315 | 10/1988 | Kohus . |
| 4,793,032 | 12/1988 | Crowle . |
| 4,802,262 | 2/1989 | Kasai ..... 24/633 X |
| 4,813,108 | 3/1989 | Geldwerth . |
| 4,819,303 | 4/1989 | Udelhofen . |
| 4,825,515 | 5/1989 | Wolterstorff, Jr. . |
| 4,831,694 | 5/1989 | Kong . |
| 4,864,700 | 9/1989 | Kasai . |
| 4,866,819 | 9/1989 | Kasai . |
| 4,894,890 | 1/1990 | Kasai . |
| 4,912,950 | 4/1990 | Crowle . |
| 4,928,364 | 5/1990 | Ikeda . |
| 4,930,324 | 6/1990 | Meier . |
| 4,976,017 | 12/1990 | Frano . |
| 4,987,661 | 1/1991 | Kasai . |
| 5,027,481 | 7/1991 | Frano . |
| 5,123,153 | 6/1992 | Krauss . |
| 5,131,122 | 7/1992 | Lavato . |
| 5,144,725 | 9/1992 | Krauss . |
| 5,148,582 | 9/1992 | Dennis, Jr. . |
| 5,170,539 | 12/1992 | Lundstedt et al. . |
| 5,203,058 | 4/1993 | Krauss . |
| 5,222,279 | 6/1993 | Frano et al. . |
| 5,291,641 | 3/1994 | Morino . |
| 5,311,649 | 5/1994 | Suh . |
| 5,322,037 | 6/1994 | Tozawa . |
| 5,359,756 | 11/1994 | Migauchi et al. ..... 24/633 X |

FOREIGN PATENT DOCUMENTS

| | | |
|---|---|---|
| 970611 | 9/1964 | United Kingdom . |
| 2125880 | 3/1984 | United Kingdom . |
| WO8501192 | 3/1985 | WIPO . |

*Primary Examiner*—James R. Brittain

*Attorney, Agent, or Firm*—Kane, Dalsimer, Sullivan, Kurucz, Eisele and Richard, LLP

[57] ABSTRACT

A releasable buckle is provided having a male member and female member. The male member includes a base having first and second sides, an end surface therebetween, at least one resilient spring arm extending from the end surface and at least one portion adjacent the first side extending from the base. The female member includes a top and bottom wall and a channel disposed therebetween and an opening exposing the cavity for receiving the male member. The female member further includes means complimentary in shape and position to the portion for receiving the portion. The portion extending from the male member and the means for receiving the male member together constitute an interlocking key system which functions to distribute the stress from the loads to the top and bottom walls of the female member.

20 Claims, 4 Drawing Sheets

SIDE RELEASE BUCKLE WITH IMPROVED DISTRIBUTION OF STRESS UNDER LOADS

BACKGROUND OF THE INVENTION

The invention relates generally to buckles, and more particularly to a side release buckle having improved distribution of stress under loads.

It is well-known in the prior art to provide a plastic buckle with a side release feature effected by pressing the side portions of the buckle. Such buckles are used in toolbelts, life preservers, harnesses, seatbelts, scuba equipment and similar apparatus. An example of such a buckle is disclosed in U.S. Pat. No. 5,222,279 to Frano et al. wherein the protuberances on the arms of the male member are depressed to release the buckle. Another example of this type of buckle is illustrated in FIGS. 1–3.

As shown in FIGS. 1–3, the buckle 10 consists of a female member 12 and male member 14. The female member 12 includes an open cavity 13 disposed therein and apertures 16, 18 formed in opposite side walls thereof. Male member 14 includes a base 20 and two resilient spring arms 22, 24 extending therefrom, each having a protuberance 26, 28 on its free end. The protuberances 26, 28 are urged into the open cavity 13 and the resilient arms 22, 24 flex inwardly as the male member 14 is inserted into the female member 6. When the male member 14 reaches its final position within the female member 16, i.e., in a locked state, the flexible arms 22, 24 flex outwardly and the protuberances 6, 28 align with and protrude from the respective apertures 16, 18.

Note that near the junction between the base 20 and the arms 22, 24 there is a collar or shoulder 30 that spans around the perimeter of the base 20 of the male member 20. The shoulder 30 interfaces with the surface of mouth 15 which defines the opening 13 to the cavity in the female member 12. In some other buckles of the prior art the shoulder of the male member may not be continuous. However, these buckles functions similarly. In other buckles of the prior art the surface of the mouth may not even interface with the male member when the buckle is in a locked state.

Under normal conditions, buckle 10 may experience stress from straight and/or torsional loads caused by the movement of the webs. The straight load is a linear force and the torsional load is a twisting force applied to the members 12, 14. Such torsional forces are illustrated in FIG. 3 as arrows A, B. Because of the construction of the prior art buckles described above, such torsional forces are exerted only on the male member 14 and cause it to bend along its length, thereby adding stress to the pre-existing stress exerted on the arms by the straight loads.

Under the additional stress, the surface of the protuberances 26, 28 may unseat from the apertures 16, 18 in the female member 12, and thus only part of the catch area of the male member 14 may interface with the female member 12 when the male and female members 12, 14 are aligned and locked. Consequently, the male member 14 may disengage from the female member 12. In addition, one of the arms 22, 24 may break under the additional stress. In this condition, the male member 14 will certainly disengage from the female member 12.

It would be therefore desirable to provide a buckle that would reduce the stress forces on the arms described above by distributing them to another portion of the buckle better suited to handle such stresses.

OBJECTS AND SUMMARY OF THE INVENTION

It is an object of the present invention to overcome the disadvantages associated with the buckles of the prior art described above.

The above object is achieved in accordance with the present invention by a releasable buckle having a male member and female member. The male member includes a base having first and second sides, an end surface therebetween, at least one resilient spring arm extending from the end surface and at least one portion adjacent the first side extending from the base. The female member includes a top and bottom wall, a channel disposed therebetween and an opening exposing the cavity for receiving the male member. The female member further includes means complementary in shape and position to the portion for receiving the portion. The portion extending from the male member and the means for receiving the male member in the female member together constitute an interlocking key system which functions to distribute the stress across the top and bottom walls of the female member.

The arm and the portion may constitute one piece. The portion has a surface in common with the outside surface of the male member. The means for receiving the portion is a recess in the side wall of the female member.

The base of the male member further has top and bottom walls between first and second sides, respectively and a shoulder on each of the top and bottom walls. The top and bottom walls each have a bevel surface extending along the length thereof from the shoulder to the end surface of the base. The female member has a mouth defining the opening to the channel which interfaces with the shoulders of the male member when the members are in a locked state. The recess is in the mouth of the female member.

The resilient arm has a protuberance at the free end thereof and the female member has at least one aperture for receiving the protuberance. The protuberance is shaped so that the resilient spring arm is urged inwardly as the male member is inserted into the channel of the female member. The arm flexes outwardly against the inside surface of the channel when the protuberance aligns with and protrudes from the aperture.

BRIEF DESCRIPTION OF THE DRAWINGS

The invention is illustrated by way of example and not limited by the figures of the accompanying drawings in which like references denote like or corresponding parts and in which:

FIG. 14(*b*) illustrates a perspective view of the male member used with the female member shown in FIG. 14 (*a*)

DESCRIPTION OF THE PREFERRED EMBODIMENT

Referring to FIGS. 4, 5, 12 and 13, buckle 50 is shown according to a preferred embodiment of the present invention. Buckle 10 includes female member 52 and male member 54. These components are typically utilized to connect free ends of webs or straps (not shown). The buckle 50 is preferably made of plastic.

Figure 6:
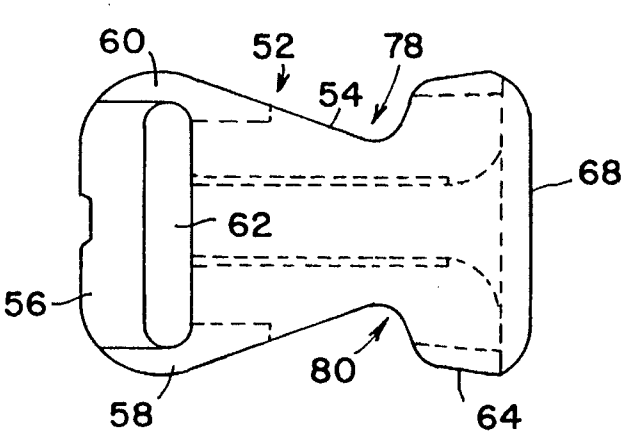
FIG. 6 illustrates a top plan view of a female member shown in FIG. 4.
Figure 8:
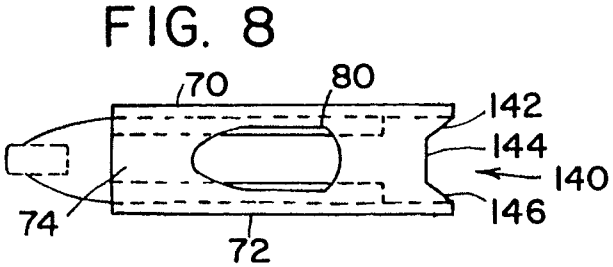
FIG. 8 illustrates a side view of the female member shown in FIG. 6.
Figure 10:
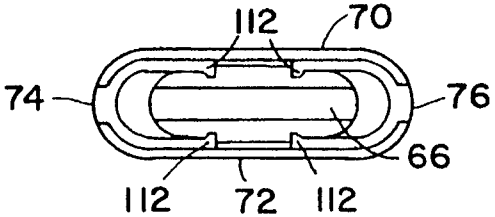
FIG. 10 illustrates a cross-sectional view of the female member shown in FIG. 6.

Referring to FIGS. 6, 8 and 10, female member 52 has a body 54, C-shaped support 56 with legs 58, 60 and an opening 62 through which the web passes. Female member 52 has a body 64 with a generally elliptical tubular shape in cross section. Body 64 includes a substantially elliptically shaped interior channel 66 disposed therein and an opening defined by mouth 68 of body 64 to receive male member 54 as described below. Body 64 is defined by top and bottom walls 70, 72 and circular side walls 74, 76. In order to provide its generally elliptical tubular shape, top and bottom walls 70, 72 are wider than the diameter of the circular side walls 74, 76.

As will be described below, male member 54 is received and releasably retained within channel 66 of female member 52. To enable access and release of male member 54 from the interior of female member 52 by a user and assist in retaining male member 54 within female member 52, female member 52 includes two apertures 78, 80.

Each aperture extends at least through a portion of top and bottom walls 70, 72 and preferably extends through both top and bottom walls as well as through opposite side walls 74, 76 to form a side-release type buckle 10. It is to be understood, however that the shape, location, position and number of apertures can vary so long as buckle 50 operates as described.

Figure 7:
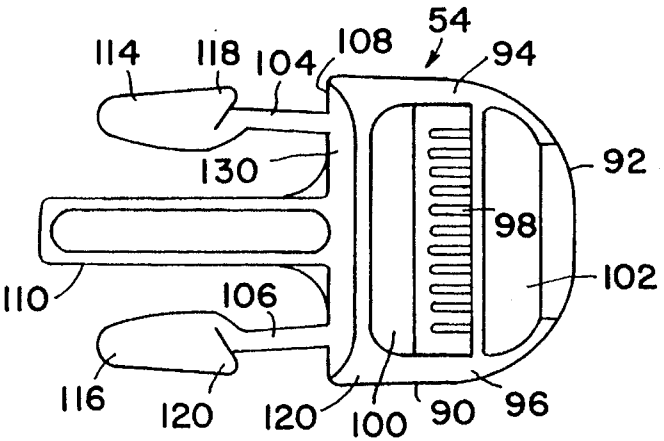
FIG. 7 illustrates a top plan view of a male member shown in FIG. 4.
Figure 9:
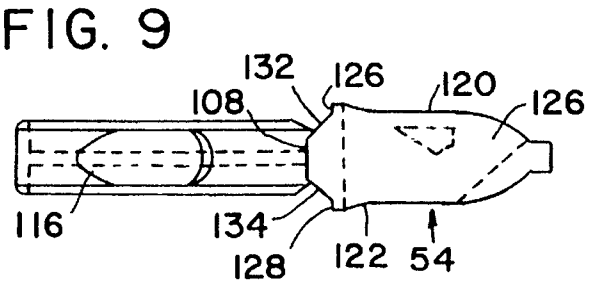
FIG. 9 illustrates a side view of the male member shown in FIG. 7.
Figure 11:
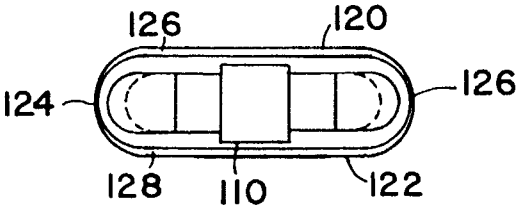
FIG. 11 illustrates a cross-sectional view of the male member shown in FIG. 7.

As illustrated in FIGS. 7, 9, and 11, male member 54 includes base 90, C-shaped support 92 and bars 94, 96 which engage web support 98 between bars 94, 96. Openings 100, 102 are formed on both sides of web support 98 to allow the passage of the web therethrough in a known manner.

Figure 12:
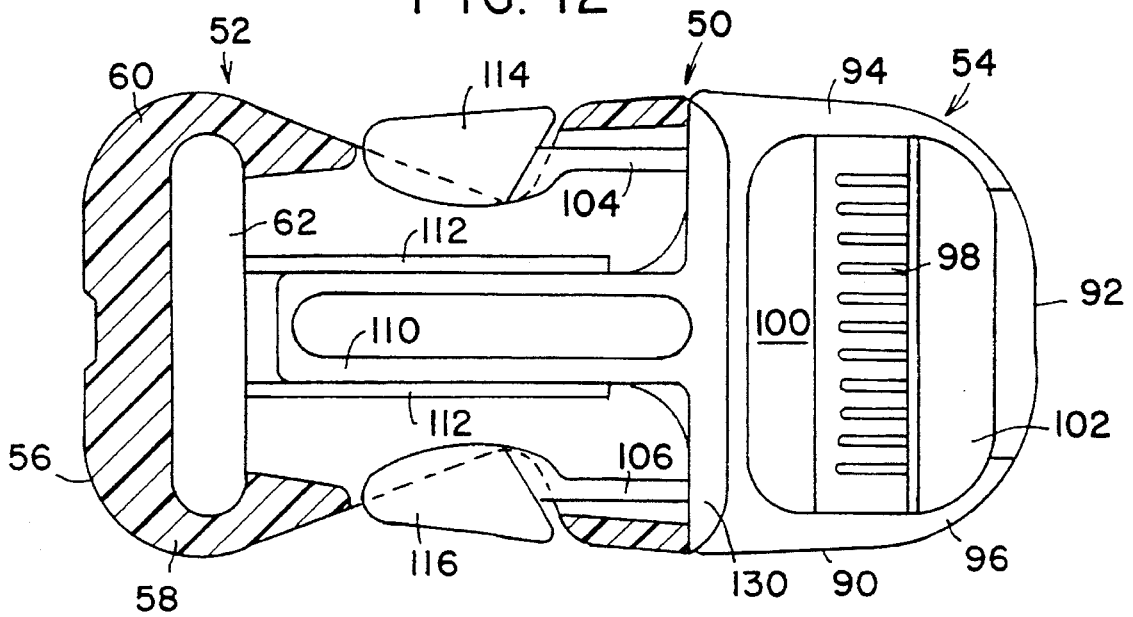
FIG. 12 illustrates the buckle shown in FIG. 4 with the top half of the female member removed.
Figure 13:
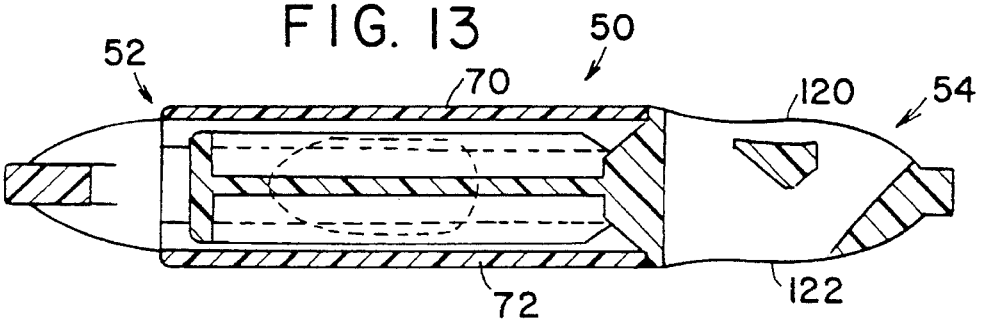
FIG. 13 illustrates a cross-sectional view of the buckle shown in FIG. 4 taken along lines 13—13.

Male member 54 has two resilient spring arms 104, 106 formed on opposite sides of base 90 and extending outwardly away a predetermined distance from end 108. To assist in insertion of male member 54 within channel 66, male member 54 includes guide arm 110 formed between resilient spring arms 104, 106 and extending from end 108 for complementary engagement with alignment grooves 112 formed within channel 66 on the inside surface of top and bottom walls 70, 72 of female member 52. These grooves 112 are shown in FIGS. 10 and 12 and in dotted lines in FIGS. 4 and 6. In an alternate embodiment, the grooves may be on the inside surface of only one wall.

Resilient arms 104, 106 include at their free ends protuberance 114, 116 respectively. Protuberances 114, 116 each have rounded edges and are specifically shaped to assist arms 104, 106 to slide into channel 66 against the inside surface thereof. Protuberances 114, 116 also include sharp projections 118, 120 to secure protuberances 114, 116 within apertures 78, 80, respectively.

Base 90 of male member 54 includes top and bottom surfaces 120, 122 and side walls 124, 126. Base 90 further includes shoulders 126, 128 in top and bottom surfaces 120, 122, respectively which extend vertically therefrom. Each shoulder 126, 128 extends substantially from side wall 124 to side wall 126. Base 90 further includes bevel surface 130 on top surface 120 which also extends from side wall 124 to side wall 126. A similar bevel surface exists on bottom surface 122 but is not shown. Bevel surface 130 extends from each shoulder 126, 128 down toward end surface 108 of base 90. The ends of bevel surfaces (top and bottom wall) form angled edges 132, 134 in side wall 126. Similarly, angled edges are formed in side wall 124 but these edges are not shown. Importantly, the combination of the vertical edge of end wall 108 and angled edges 132, 134 form an interlocking key which functions as described below. The vertical edge of wall 108 and the angled edges of wall 124 not shown also form a second interlocking key.

Side wall 74 defining mouth 68 (and side wall 76 but not shown) has recess 140 formed therein comprising angled edges 142, 146 and vertical edge 144. Angled edges 142, 146 and vertical edge 144 together form an interlocking key receptacle or recess which is complementary in shape to the interlocking key of male member 54, i.e., to angled edges 132, 134 and end wall 108, to receive the interlocking key of male member 54. A similar recess is formed on the opposite side wall of the female member to receive the interlocking key not shown. The lips of mouth 68 on top and bottom walls 70, 72 are shaped to cover i.e., butt up against the surface area of shoulders 126, 128. In the preferred embodiment, the surface area of both shoulders 126, 128 are equal in size. However, the surface area of each shoulder 126, 128 may be different, and may also be angled. Also, in the preferred embodiment, bevel surface 130 and the bevel surface on the bottom wall are equal in area, and are equal in angle measure. However, the bevel surfaces may have different measurements for their surface areas and may have different measurements for their angles.

To connect male member 54 to female member 52, resilient arms 104, 106 are inserted within channel 66 through mouth 68. With continued insertion, arms 104, 106 are flexed toward the interior of channel 66 while the protuberances slide along the interior surface of channel 66. When protuberances 114, 116 reach apertures 78, 80, each arm snaps outwardly with respect to the channel 66 and projections 118, 120 are seated against the edge defining apertures 78, 80. To release male member 54 from female member 52, a user exerts pressure on protuberances 114, 116 to flex arms 104, 106 inwardly. Once protuberances are clear of the inside surface of channel 66, male member 54 can be removed from channel 66.

Importantly, when buckle 50 is in a locked state, the interlocking keys of male member 54 and the interlocking key receptacles of female member 52 together form a system that applies or distributes the torsional loads across top and bottom walls 70, 72 of female member 52. That is, the interlocking key system has thus transferred the torsional loads from resilient arms 104, 106 to the top and bottom walls of female member 52. In addition, the interlocking system helps guide arm 110 and resilient arms 104, 106 of male member 54 to guide squarely in line with the load. Also, if the webbing should become kinked to one side under load, the interlocking key system prevents the male or female member 54, 52 from being pulled side to side. That is, the interlocking system helps maintain a straight line pull on buckle 50. This enables resilient arms 104, 106 to perform their locking function. Male member 54 will therefore remain completely engaged.

Figure 1:
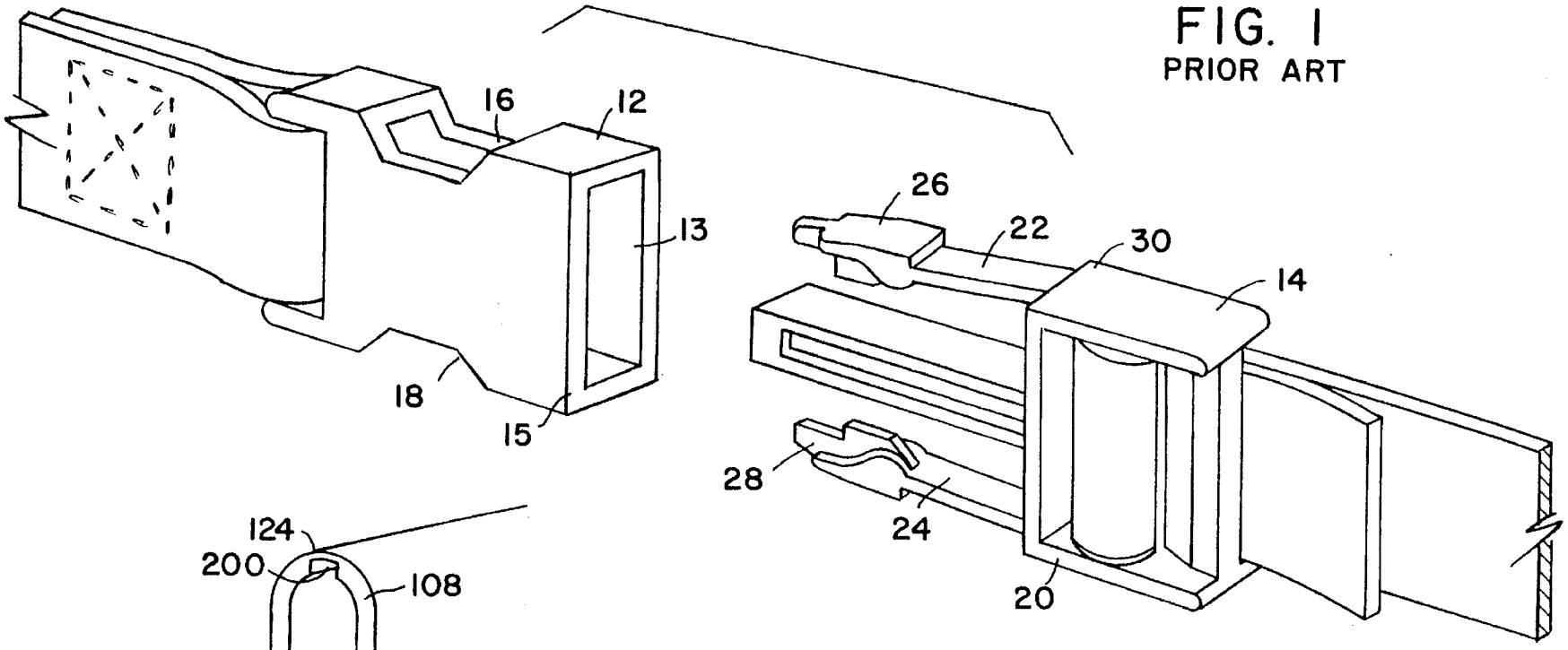
FIG. 1 PRIOR ART
FIG. 1 illustrates a perspective view of a side release buckle of the prior art.
Figure 14B:
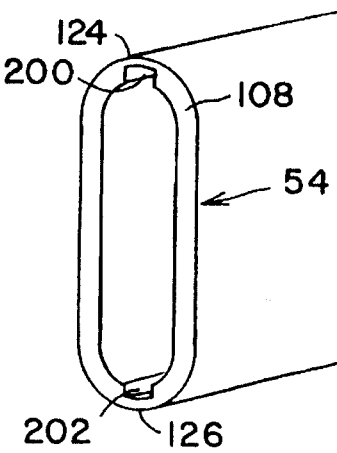
FIG. 14(*a*) illustrates a cross-sectional view of the female member according to another embodiment of the present invention.
Figure 2:
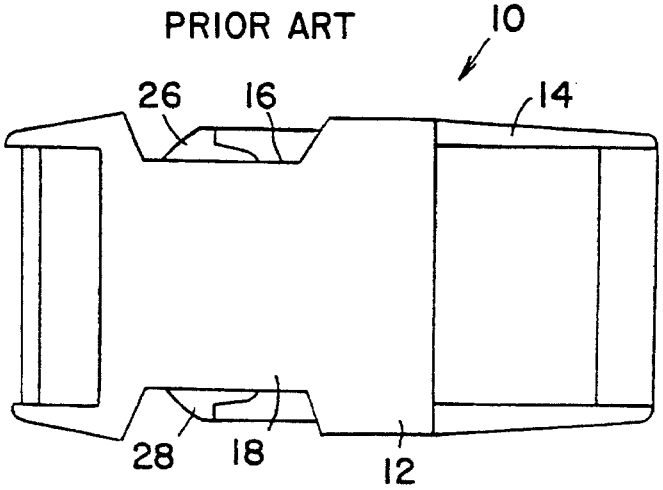
FIG. 2 PRIOR ART
FIG. 2 illustrates a top perspective view of the buckle shown in FIG. 1.
Figure 3:
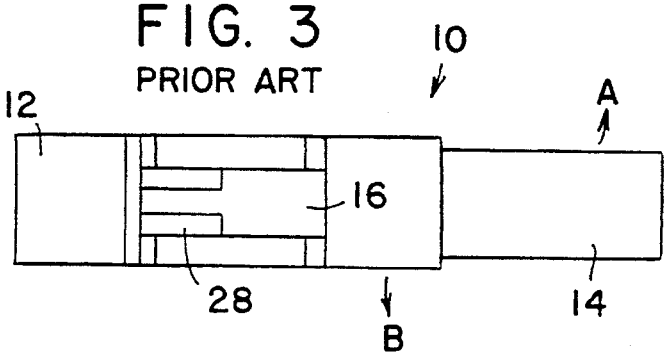
FIG. 3 PRIOR ART
FIG. 3 illustrates a side view of the buckle shown in FIG. 1.
Figure 4:
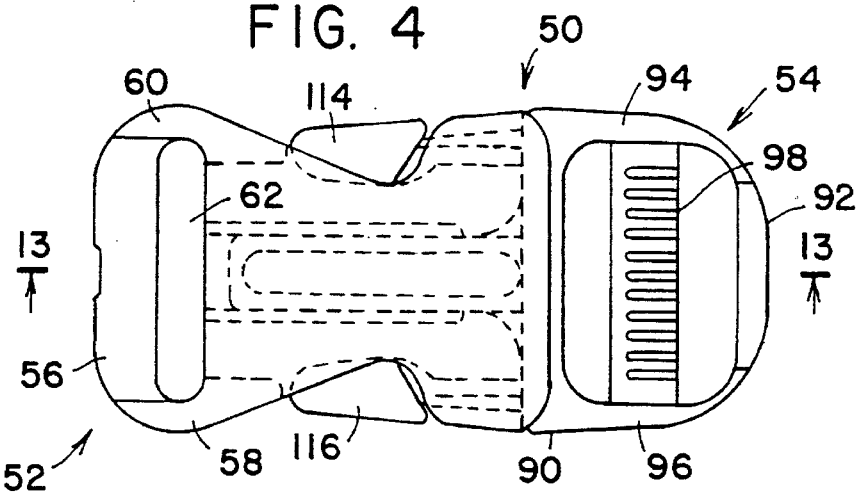
FIG. 4 illustrates a top plan view of the side releasable buckle in a locked state according to a preferred embodiment of the present invention.
Figure 5:
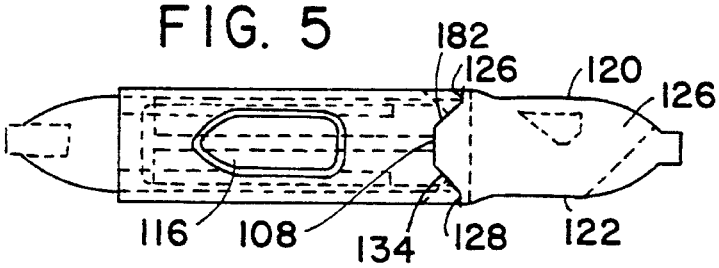
FIG. 5 illustrates a side view of the buckle shown in FIG. 4.
Figure 14A:
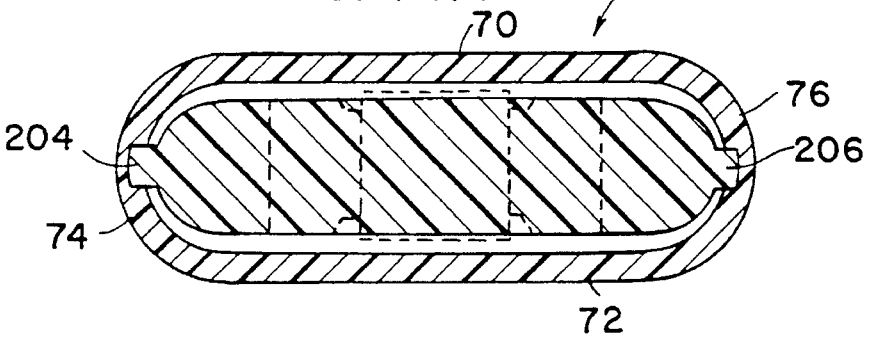

FIGS. 14(*a*) and 14(*b*) show male and female members respectively according to an alternative embodiment of the present invention. Similar to the male member described above, male member 54 in FIG. 14(*b*) includes two resilient arms (not shown) and two portions 200, 202 adjacent the respective circular side walls 124, 126 extending outwardly from end 108. Portions 200, 202 and the resilient arms are preferably molded as one piece. Portions 200, 202 each have a length that measures roughly one fifth (⅕) the length of a resilient arm. Portions 200, 202 are preferably rectangular shaped but may have other shapes that obtain the same effects as described below.

In the embodiment shown in FIG. 14(*b*), rectangular portions 200, 202 are separate and apart from side walls 124, 126. However, these portions 200, 202 may share a surface in common with the surface of side walls 124, 126.

Female member 52 has complementary shaped recesses 204, 206 in side walls 74, 76 to receive rectangular portions 200, 202 respectively. The rectangular portions and complementary recesses together obtain the same results as the preferred embodiment of the buckle described above. That is, when the male and female members are locked, the rectangular portions and the forces along the top and bottom walls of female member 52.

Figure 15:
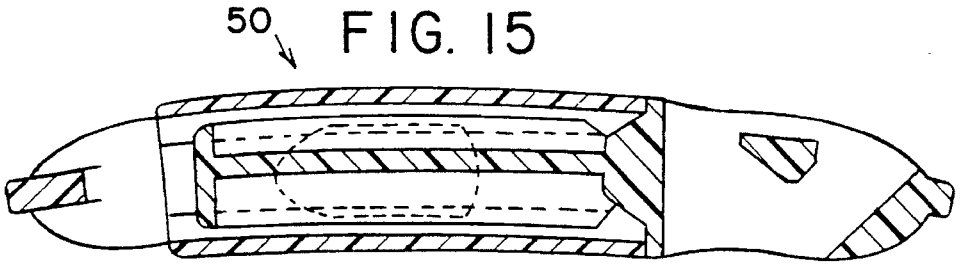
FIG. 15 illustrates a side view of a buckle according to another embodiment of the present invention.

FIG. 15 shows an alternative embodiment of buckle 50. Note that the buckle 50 is arc shaped. Otherwise, it is structurally and functionally the same as the preferred embodiment of the buckle described above.

Although the invention has been described with reference to the preferred embodiment, it will be apparent to one skilled in the art that variations and modifications are contemplated within the spirit and scope of the invention. The drawings and description of the preferred embodiments are made by way of example rather than to limit the scope of the invention, and it is intended to cover within the spirit and scope of the invention all such changes and modifications.

I claim:

1. A buckle comprising:

a male member including a base having top and bottom walls, first and second sides and an end surface between said top and bottom walls and said first and second sides, and first and second resilient arms extending from said end surface, said arms each having a protuberance at the free end thereof, said male member further having a portion extending from said base adjacent said first side; and a female receptacle member including a body, an interior channel extending therein and a mouth defining an opening to said channel, first and second apertures formed within said channel through which said protuberances are exposed when said female and male members are in a locked position and said arms inserted into said opening, said female member further including means complementary in shape and position to said portion for receiving said portion, said protuberances shaped so as to urge said resilient spring arm inwardly as said male member is inserted into said channel of said female member, said arm flexing outwardly when said protuberance aligns with and protrudes from said aperture.

2. The buckle of claim 1 wherein said top and bottom walls each have a shoulder adjacent said end surface extending exteriorly from said first side to said second side for engaging said mouth and thereby covering said opening in said female member.

3. The buckle of claim 1 wherein said top and bottom walls each have a bevel surface extending from said first side to said second side.

4. The buckle of claim 3 wherein the edges of said end surface and said bevel surface of said top and bottom walls adjacent said side wall define said portion.

5. The buckle of claim 4 wherein said bevel surface of said top wall measures a greater area than the area of said bevel surface of said bottom wall.

6. The buckle of claim 4 wherein the area of said bevel surface of said top and bottom walls are equal.

7. The buckle of claim 1 wherein said portion extends from said end surface.

8. The buckle of claim 7 wherein said portion is rectangular.

9. The buckle of claim 1 wherein said portion and said first arm constitute one piece.

10. The buckle of claim 1 wherein said female member has a wall and said means for receiving said portion comprises a recess in said wall.

11. The buckle of claim 10 wherein the outside surface of said wall has an opening to said recess.

12. A buckle comprising:

a male member including a tubular base having a top wall and a bottom opposite wall, a first side and a second opposite side and an end surface between said top and bottom walls and said first and second sides, and first and second resilient spring arms extending from said end surface outwardly away therefrom, each arm having a protuberance at its free end, said base further having first and second projections adjacent said first and second sides respectively and each projection extending from said end surface; and a female receptacle member including a body, an interior channel extending therein and a mouth defining an opening to said channel at one end thereof, and first and second apertures formed within said channel through which said protuberances are exposed when said female and male members are in a locked position and said arms are inserted into said opening, said female member further including first and second means complementary in shape and position to said first and second projections for receiving said first and second projections respectively, said protuberances shaped so as to urge said resilient spring arms inwardly as said male member is inserted into said channel of said female member, said arms each flexing outwardly when said protuberance align with said aperture.

13. The buckle of claim 12 wherein said first and second projections each have a rectangular shape.

14. The buckle of claim 12 wherein said first and second projections each have a side surface in common with the outside surface of said body of said male member.

15. The buckle of claim 12 wherein said female member has first and second side walls and said means for receiving said projections comprises first and second recesses in said first and second side walls respectively.

16. The buckle of claim 15 wherein the outside surface of said first and second walls each have an opening to said recess.

17. A buckle comprising:

a male member including a tubular base having a top wall and a bottom opposite wall, a first side and second opposite side and an end surface between said top and bottom walls and said first and second sides, said end surface having an edge, and first and second resilient spring arms extending outwardly away from said end surface, each arm having a protuberance at its free end, said top and bottom walls each having a bevel surface extending from said first side to said second side and extending generally from said wall to said end surface, said top and bottom bevel surfaces each having an edge adjacent said sides, said edges of said bevel surface and the edge of said end surface forming an interlocking key portion adjacent each side; and a female receptacle member including a body, an interior channel extending therein and a mouth defining an opening to said channel at one end thereof, and first and second apertures formed within said channel through which said protuberances are exposed when said female and male members are in a locked position, said female member including first and second means complementary in shape and position to said first and second key interlocking portions for receiving said key portions, said protuberances shaped so as to urge said resilient spring arms inwardly as said male member is inserted into said channel of said female member, said arms each flexing outwardly when said protuberance aligns with said aperture.

18. The buckle of claim 17 wherein female member has a wall and said first and second means for receiving said first and second interlocking key portions each comprise a receptacle, said receptacle having an opening in said wall for receiving said key portion.

19. The buckle of claim 18 wherein said male member includes first and second shoulders formed on said top and bottom walls respectively for interfacing with said mouth when said buckle is in a locked state.

20. A buckle comprising:

a male member including a base having top and bottom walls, first and second sides and an end surface between said top and bottom walls and said first and second sides, and first and second resilient arms extending from said end surface, said arms each having a protuberance at the free end thereof, said male member further having a portion extending from said base adjacent said first side; and a female receptacle member including a body, an interior channel extending therein and a mouth defining an opening to said channel, first and second apertures formed within said channel through which said protuberances are exposed when said female and male members are in a locked position and said arms are inserted into said opening, said female member further including means complementary in shape and position to said portion for receiving said portion, said protuberances shaped so as to urge said resilient spring arm inwardly as said male member is inserted into said channel of said female member, said arm flexing outwardly when said protuberance aligns with and protrudes from said aperture, said top and bottom walls each have a bevel surface extending from said first side to said second side, the edges of said end surface and said bevel surface of said top and bottom walls adjacent said side wall define said portion, said bevel surface of said top wall measures a greater area than the area of said bevel surface of said bottom wall.

* * * * *